United States Patent [19]

Akashi

[11] 4,155,147

[45] May 22, 1979

[54] TOP STOPS FOR SLIDE FASTENERS

[75] Inventor: Shunji Akashi, Kurobe, Japan

[73] Assignee: Yoshida Kogyo Kabushiki Kaisha, Tokyo, Japan

[21] Appl. No.: 853,845

[22] Filed: Nov. 22, 1977

[30] Foreign Application Priority Data

Nov. 30, 1976 [JP] Japan ..... 51-161028[U]

[51] Int. Cl.[2] ..... A44B 19/24

[52] U.S. Cl. ..... 24/205.11 F

[58] Field of Search ..... 24/205.11 R, 205.11 F

[56] References Cited

U.S. PATENT DOCUMENTS

| | | | |
|---|---|---|---|
| 1,794,139 | 2/1931 | Blair | 24/205.11 R |
| 2,483,703 | 10/1949 | Legat | 24/205.11 R |
| 3,482,292 | 12/1969 | Frohlich | 24/205.11 F |
| 3,864,792 | 2/1975 | Takahashi et al. | 24/205.11 R |
| 4,034,445 | 7/1977 | Stephens | 24/205.11 F |
| 4,045,845 | 9/1977 | Kando | 24/205.11 F |

*Primary Examiner*—Kenneth J. Dorner

*Attorney, Agent, or Firm*—Bucknam and Archer

[57] ABSTRACT

A top stop of thermoplastic material is thermally fused onto a plurality of topmost scoops of a continuous coupling element on each stringer tape to limit the upward or fastener closing movement of the slider. The top stop is substantially L-shaped, comprising a longitudinal portion embracing the coupling heads of several topmost scoops and a transverse portion bent outwardly from the upper extremity of the longitudinal portion to secure the stitching thread to the extreme endmost scoop or scoops.

2 Claims, 8 Drawing Figures

TOP STOPS FOR SLIDE FASTENERS

BACKGROUND OF THE INVENTION

1. Field of the Invention

This invention relates to slide fasteners, and in particular to an improved top stops for arresting the movement of a slider beyond its fully closed position on a pair of stringers for a slide fastener.

2. Description of the Prior Art

Top stops have been known and used extensively which are made of metal or plastics and which are mechanically or thermally secured to the topmost scoops or fastener elements of slide fastener stringers. These known top stops are usually unsatisfactory in appearance. Some prior art top stops, moreover, are liable to permit the stitches attaching the scoops to the stringer tapes to bend sharply around their edges tapes, thereby tearing or breaking the stitching threads.

SUMMARY OF THE INVENTION

It is an object of this invention to provide an improved construction of top stops that can be readily mounted in position on a pair of fastener stringers in a manner meeting the utilitarian and aesthetic requirements of use.

Another object of the invention is to provide an improved top stop construction which is readily adaptable for use with coupling elements of various types.

Still another object of the invention is to provide a top stop for slide fasteners which prevents sewing threads therearound from being damaged.

In accordance with this invention, briefly stated, there is provided a top stop of thermoplastic material thermally fused onto a plurality of topmost ones of a row of scoops stitched onto a stringer tape. The top stop comprises a first portion embracing at least the coupling heads of the topmost scoops from opposite sides (i.e., front and rear) thereof, and a second portion overlying the row of stitches.

Advantageously, the top stop of this invention can be mounted in position on the stringer without causing any substantial deformation of the scoops, so that the appearance of the completed slide fastener does not deteriorate to the slightest degree. Also, the top stops thus attached to a fastener chain during the manufacture of slide fasteners do not interfere with the succeeding manufacturing or finishing steps. Furthermore, each top stop can retain the stitches against sharp bending around its edge without any posibility of tearing or breaking the stitches in the use of the slide fastener.

The above and other objects, features and advantages of this invention and the manner of attaining them will become more readily apparent, and the invention itself will best be understood, from the following description of preferred embodiments taken in connection with the accompanying drawings.

DESCRIPTION OF THE PREFERRED EMBODIMENTS

Figure 1:
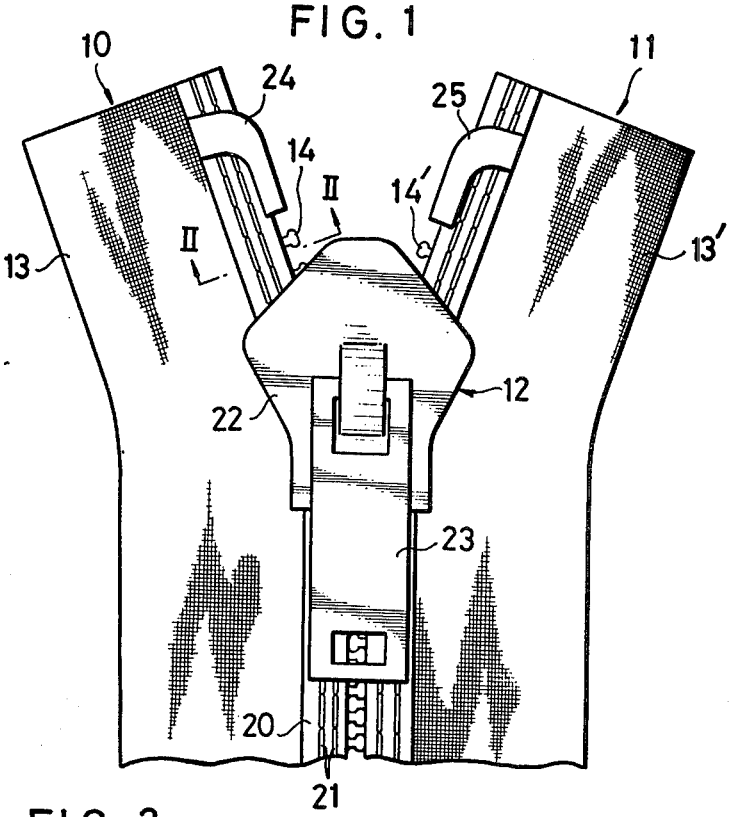
FIG. 1 is a partial front elevational view of a slide fastener incorporating the top stops embodying the principles of this invention.

Referring to FIGS. 1 through 5 thereof, top stops in accordance with this invention are therein particularly adapted for a slide fastener having continuous coupling elements of the zigzag type. As shown in FIG. 1, the slide fastener comprises a pair of stringers 10 and 11 which can be connected and disconnected, or closed and opened, by a slider 12 in the well known manner. Since the paired stringers 10 and 11 are of identical construction, only the stringer 10 will be described in detail, and the reference numerals used to denote various parts of this stringer will be simply primed to denote corresponding parts of the other stringer 11.

Figure 2:
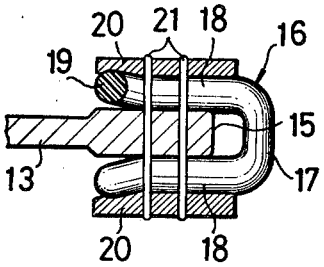
FIG. 2 is an enlarged, partial cross-sectional view taken along the line II—II of FIG. 1.
Figure 3:
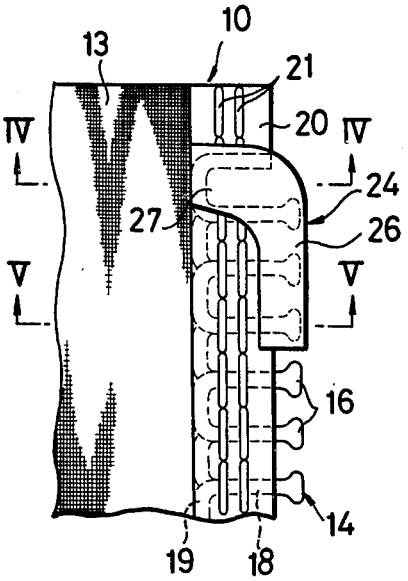
FIG. 3 is an enlarged, partial front elevational view showing one of the stringers of FIG. 1 together with the top stop mounted thereon.

In FIGS. 1 through 3, the stringer 10 includes a tape 13 carrying the continuous coupling element 14 of the zigzag type on and along its beaded or thickened inner edge 15 disposed opposite to the other stringer 11. As is well known, the continuous coupling element 14 is in the form of a filamentary synthetic resin bent in a zigzag configuration to provide a row of scoops 16 all of which are substantially U-shaped, comprising coupling heads 17 for mating interengagement with the corresponding coupling heads of the complementary coupling element 14' of the other stringer 11, and pairs of legs 18 extending transversely and outwardly from the respective coupling heads 17. The coupling element 14 additionally includes connective portions 19 extending longitudinally to connect the outer extremities of the legs 18 of each scoop 16 to the corresponding extremities of the legs of an upper and a lower scoop.

The continuous coupling element 14 is mounted on the stringer tape 13 with the scoops 16 disposed astraddle the inner edge 15 of the tape, that is, with the legs 18 of each scoop disposed on opposite sides of the tape. Cover strips 20 extend longitudinally of the stringer tape 13 so as to cover at least part of the legs 18 of the continuous coupling element 14 on the opposite sides of the tape. The continuous coupling element 14 together with the cover strips 20 is fastened to the stringer tape 13 by a dual row of stitches 21.

The slider 12 is of conventional construction comprising a body 22 defining a usual Y-shaped guide channel therein, and a pull tab 23 for manipulating a slider. It is therefore apparent that the slide fastener of FIG. 1 can be closed and opened as desired by the slider 12 as the latter is moved along the continuous coupling elements 14 and 14' for engaging and disengaging the scoops 16 and 16'.

For arresting the movement of the slider 12 in its uppermost or fully closed position on the pair of fastener stringers 10 and 11, there is provided a complementary pair of top stops 24 and 25 constructed in accordance with this invention. Since both top stops 24 and 25 can be of similar contour, only the top stop 24 on the stringer 10 will be described in detail, it being understood that the same description is applicable to the other top stop 25 on the stringer 11.

Figure 4:
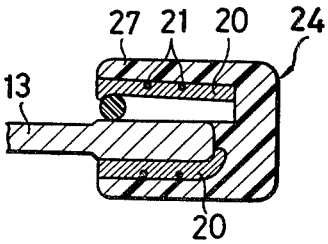
FIG. 4 is a cross-sectional view taken along the line IV—IV of FIG. 3.
Figure 5:
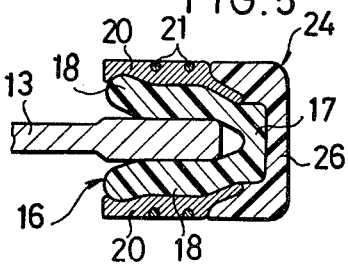
FIG. 5 is a cross-sectional view taken along the line V—V of FIG. 3.

As best shown in FIGS. 3 through 5, the top stop 24 is a substantially L-shaped piece of thermoplastic material such as, for example, nylon or ethylene resin. The top stop 24 comprises a first or longitudinal portion 26 of substantially U-shaped cross section (FIG. 5) embracing the coupling heads 17 of several topmost ones of the scoops 16 on the stringer tape 13 from the opposite sides thereof, and a second or transverse portion 27, also of substantially U-shaped cross section (FIG. 4), bent outwardly from the upper extremity of the longitudinal portion and serving to secure the stitches 21 to the extreme endmost scoop or scoops, or to the stringer tape 13, via the cover strips 20 on the opposite sides of the tape. The transverse portion 27 of the top stop 24 extends over the stitches 21.

The top stop 24 is mounted in position on the stringer 10 by being fused onto same as by a conventional high frequency or ultrasonic heating method. During this mounting operation, the fused thermoplastic material enters the gaps between the several endmost scoops 16, so that upon solidification of the thermoplastic material, these endmost scoops can be securely retained in position relative to each other and to the stringer tape 13 by the longitudinal portion 26 of the top stop 24. Furthermore, since the longitudinal portion 26 of the top stop prevents the stitches 21 from being bent sharply around the edge of the transverse portion 27, there is no possibility of the stitches being damaged by the top stop during use.

Figure 6:
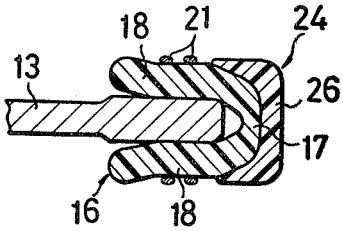
FIG. 6 is a view similar to FIG. 5 but showing a slight modification of the embodiment of FIGS. 1 through 5.

It will be seen that the top stops in accordance with this invention are readily adaptable for use with zigzag-type continuous coupling elements having no cover strips, as illustrated in FIG. 6, which is a cross-sectional view corresponding to FIG. 5 and in which parts corresponding to those shown in FIG. 5 are identified by the same reference numerals. In this adaptation, of course, the stitches 21 are secured directly to the extreme topmost scoop or scoops 16 by the transverse portion 27 of the top stop 24.

Figure 7:
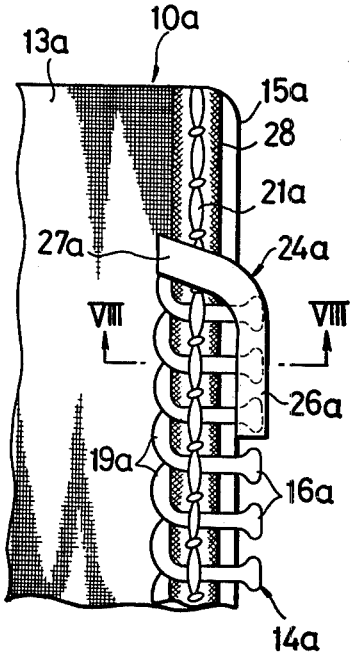
FIG. 7 is a view similar to FIG. 3 but showing another adaptation of the invention.
Figure 8:
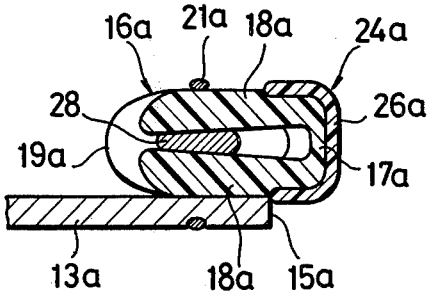
FIG. 8 is a cross-sectional view taken along the line VIII—VIII of FIG. 7.

The coupling elements for use with the top stops of this invention may not necessarily be mounted astraddle the inner edges of stringer tapes as in the preceding embodiments. In order to demonstrate this, the invention is shown in FIGS. 7 and 8 as adapted for use with continuous coupling elements of the helicoidal type generally designated 14*a*. As is well known, the helicoidal coupling element 14*a* has a multiplicity of generally similar turns to serve as scoops 16*a*. Each scoop 16*a* comprises a coupling head 17*a* and a pair of legs 18*a*, and the legs of each scoop are connected with the adjacent legs by bight portions 19*a* bridging the turns.

The helicoidal coupling element 14*a* is disposed on one side of the stringer tape 13*a* and extends along its inner edge 15*a*. A core cord 28 extends longitudinally through the turns of the helicoidal coupling element 14*a*, and this coupling element is fastened to the stringer tape 13*a* by a row of stitches 21*a* passing through the core cord.

Mounted in position on the stringer 10*a* of the foregoing construction by being fused thereto is a top stop 24*a* in accordance with this invention comprising a first or longitudinal portion 26*a* embracing the coupling heads 17*a* of a plurality of topmost ones of the scoops 16*a*, and a second or transverse portion 27*a* serving to secure the stitches 21*a* to the extreme topmost scoop or scoops or to the core cord 28. The transverse portion 27*a* extends obliquely outwardly from the upper extremity of the longitudinal portion 26*a*. The other details of construction and functions are as set forth above in connection with FIGS. 1 through 5.

Although the present invention has been shown and described specifically for use with continuous coupling elements of the zigzag and the helicoidal types, it is understood that these adaptations are by way of example only, the invention being readily adaptable for slide fasteners of various types other than those disclosed herein. Furthermore, the illustrated forms of the top stops in accordance with the invention are believed to admit of many modifications within the usual knowledge of one skilled in the art, without departing from the scope of the appended claims.

What is claimed is:

1. A slide fastener stringer comprising, in combination, a tape, a row of scoops arranged along an inner longitudinal edge of said tape and having coupling heads for mating interengagement with the corresponding coupling heads of a complementary row of scoops of another stringer, a row of stitches fastening said scoops to said tape, and a top stop of thermoplastic material thermally fused onto a plurality of topmost ones of said scoops, said top stop including a first portion having a U-shaped cross-section embracing at least the coupling heads of the topmost scoops externally from opposite sides thereof and a second portion having a U-shaped cross-section overlying said row of stitches, said top stop being of generally L-shaped configurations, said first portion of the top extending along the inner longitudinal edge of the tape, and said second portion of the top stop being bent outwardly from the upper extremity of said first portion.

2. A slide fastener stringer according to claim 1, wherein said second portion of the top stop extending obliquely outwardly from the upper extremity of said first portion.

* * * * *